US007980235B1

(12) United States Patent
Kronengold et al.

(10) Patent No.: US 7,980,235 B1
(45) Date of Patent: Jul. 19, 2011

(54) PORTABLE DEVICE FOR SERVICING A COMPOUND BOW

(75) Inventors: David H. Kronengold, Tucson, AZ (US); Scott F. Coffinger, Oro Valley, AZ (US); Kevin Hansen, Tucson, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 529 days.

(21) Appl. No.: 12/117,222

(22) Filed: May 8, 2008

(51) Int. Cl.
*F41B 5/14* (2006.01)

(52) U.S. Cl. ..... 124/1; 124/86

(58) Field of Classification Search ..... 124/1, 23.1, 124/80, 86
See application file for complete search history.

(56) References Cited

U.S. PATENT DOCUMENTS

| | | | | |
|---|---|---|---|---|
| 3,294,078 | A | 12/1966 | Allen | 124/23 |
| 3,416,220 | A | 12/1968 | Wilson | 29/446 |
| 4,074,409 | A | 2/1978 | Smith | 29/235 |
| 4,077,385 | A * | 3/1978 | Fredrickson | 124/25.6 |
| 4,291,452 | A | 9/1981 | Whitman, Sr. et al. | 29/235 |
| 4,599,987 | A | 7/1986 | Rezmer | 124/23 |
| 4,846,142 | A | 7/1989 | Tone | 124/90 |
| 5,125,389 | A | 6/1992 | Paff | 124/86 |
| 5,425,350 | A | 6/1995 | Egusquiza | 124/86 |
| 5,606,963 | A | 3/1997 | Wenzel et al. | 124/86 |
| 5,746,192 | A | 5/1998 | Gissel | 124/1 |
| 6,957,647 | B2 | 10/2005 | Evans et al. | 124/86 |
| 7,089,923 | B2 | 8/2006 | Johnson | 124/1 |

* cited by examiner

*Primary Examiner* — John Ricci
(74) *Attorney, Agent, or Firm* — Cahill Glazer PLC

(57) ABSTRACT

A portable bow press made of three distinct and separable parts. The first two parts contain loop assemblies made of steel wire formed into a U-shaped loop with the two ends connected via a bolt. The third part is a connection cable with S-hooks on either end that hook into the loop elements. The bolts in the loop assemblies are applied through tooling holes in pulleys on the limbs of a compound archery bow. The bow press is applied once the loop assemblies are in place. The limbs can be forced inward by drawing the bowstring creating enough slack for the connection cable to be hooked on either end to the loops. When the bowstring is released, the limbs are held by tension in the cable and loops to a point where they are closer than at brace height. When the bow press is applied, the bowstring is loose and maintenance can be applied to the bow, before disengaging the bow press.

18 Claims, 2 Drawing Sheets

PORTABLE DEVICE FOR SERVICING A COMPOUND BOW

BACKGROUND OF THE INVENTION

1. Field of the Invention

The present invention relates to the maintenance, repair, and use of archery bows, and more specifically compound bows. The invention is a portable bow press which allows the relief of tension on the bowstring on a high powered compound bow in order to facilitate repair, maintenance, aligning the pulleys, tightening the bowstring, stringing and unstringing of the bowstring and replacement of parts.

2. Description of the Related Art

Archery bows are a common tool of the hunter, sportsman, and warrior that have evolved over centuries. Artisans have constructed bows out of various materials, shapes and designs during this long history. Originally crafted in a single curve, bows have undergone many iterations including the long bow and recurve bow leading to today's most advanced compound bows. Compound bows differ from other bows in that they consist of multiple parts, including: a single riser made of a strong durable material with flexible limbs connected at either end of the riser to store the potential energy during draw. The bowstrings on a compound bow are connected indirectly to the limbs by means of pivoting eccentric pulleys (wheels or cams). Each pulley is connected towards the end of a limb with a rotation axis virtually perpendicular to the limb length.

Before the advent of the compound bow, maintenance and repair of simpler bows was accomplished by applying pressure to the outside of the limbs, forcing them inwards to create slack on the bowstring. Bows made of a single material could often be strung without the use of special equipment; the archer attaching one end of the string to a limb and exerting a force parallel to the bowstring. For instance see U.S. Pat. No. 3,416,220 to Richard I. Wilson disclosing the manual application of a bowstring to a single structure bow. This apparatus assists the archer in application of a force parallel to the bowstring to apply the string to the ends of the bow limbs. However, the methods that were commonly used to apply a bowstring to traditional bows are ineffective for the compound bows because of the stiffness of the compound bow limbs, additional force needed, and the complex mechanism and fine tuning requirement of the cams. Stringing and other maintenance on the compound bow cannot be easily accomplished without mechanical assistance.

Early bow presses consisted of large vice structures that would encompass and surround the entire bow and exert pressure from outside the bow to compress the limbs inward. Such vices are generally mounted to a floor within a workshop and are much too large for the hunter on the go. As an improvement to the vice, new mechanisms were invented to allow one to slacken and hold the bowstring while away from the workshop.

The ability to service a bow in the field is a highly desired feature in the archery market. Various portable mechanisms for stringing compound bows are disclosed. For example, U.S. Pat. Nos. 4,074,409; 4,291,452; 4,599,987; 4,846,142; 5,125,389; 5,606,963; 5,746,192; 6,957,647; 7,089,923 issued respectively to Jimmie T. Smith, Archie E. Whitman et al., Leonard D. Rezmer et al., Richard Tone, Edwin Paff, Paul J. Wenzel, Edward B. Gissel, Jeremy M. Evans et al., and Kenneth Johnson.

The '409 patent to Smith discloses an apparatus to assist in the changing of a bowstring on a compound bow. The '409 patent includes an auxiliary cord which connects directly to the bow cable above and below the string attachment elements. The cord is slidably connected to the bow cable at one end of an elongated handle, enabling the exertion of a force generally parallel to the bowstring to pull the distal ends of the limbs together to slacken the bowstring. The other end of the handle has an aperture through which the cord is placed to allow the handle to slide along the cord. The brackets set forth in the '409 patent connect directly to the bowstring, as an example of many of the portable bow press mechanisms.

The '452 patent to Whitman et al. also attaches a tension relieving apparatus directly to the bowstring. The '452 patent comprises an auxiliary cable, whose ends attach via clamp means to the bowstring between the cams.

The '923 patent to Johnson returns to the idea of the vice bow press with portable extending members that attach at the ends of limbs to provide pressure. The placement of the members provides for a safer tensioning system and allows easier draw due to the mechanical advantage of the extension.

The tensioning apparatus disclosed in U.S. Pat. No. 5,125,389 to Paff represents an improvement on the prior art by connecting a portable bow press temporarily in the space between split limbs on the compound bow. As compound bows have evolved to place the eccentric pulleys at the ends of the limbs, most modern compound bows feature a split limb with a eccentric pulley connected via an axle that runs between the two prongs of the split limb. The '389 patent takes advantage of this assembly by orienting an anchor within the limbs so as to apply pressure to the limbs directly, allow for easy attachment of the press, and leave the bowstring free for further manipulation. U.S. Pat. Nos. 5,746,192 and 6,957,647 contain the same anchor mechanisms as the '389 patent and offer improvements in the tightening mechanisms.

All technologies that place force directly to the limbs risk damage to the limbs as the limbs are not designed for force application at places other than the pulley axle. U.S. Pat. No. 5,606,963 overcomes this problem by applying the adjustment device to the pivot bore of the cam. Unfortunately, the apparatus disclosed in the '963 patent requires the application of the device within the space between the limb prongs and must be applied prior to the initial mounting of the pulleys and pulley axle. Additionally, this solution provides an inordinate amount of force off the center line of the bow limb that can cause an inequality in the forces and exert substantial torque on the limbs. This off-center force, and resulting torque, risks over stressing the limbs that may cause breaks along the limb.

The advent of the compound bow introduced a new and extraordinary amount of complexity into bow design. One of the main difficulties facing designers of these bows, is the calculation and adaptation of design to balance the torsional pulley forces expressed through the pulley axle on the bow limbs. Torque occurs as various forces pull on the limbs, and at the pulley(s). The translation of forces occurring at the pulley(s) causes smaller forces to be expressed along the bowstring and larger forces applied on cables that draw the limbs. The placement of the pulley and its various components in relation to the true center of the limbs is an important factor to combat the torque and its ill effects on compound bows. For instance, a wide-pulley design causes the maximum limb torque at rest, or zero draw, and a minimum torque at full draw. Diagonally-grooved-wide pulleys spread the two opposite forces on the limbs over zero- and full-draw, reaching a minimum torque as the bowstring is drawn (yolk-systems tend to deal with torque in a similar fashion). Narrow-eccentric pulleys with cable-guards tend to allow little torque at rest, and maximize torque at full draw. Misplaced, unusual, and strong torque is a major cause of bow wear and tear and can often lead to cracking of limbs, both horizontally and vertically.

No prior art bow press has completely accommodated the torque issues by allowing a bow press to connect directly at the pulley. Furthermore, as each bow is designed differently, it is often difficult to design a bow press that can adequately meet the needs of all various bow designs. Pulleys, wheels and cams, are also designed in such a varied fashion that at a time it was incomprehensible to apply a bow press, or any functioning element, at, on, or through the pulley.

It is therefore an object of the present invention to provide an portable compound bow press and tensioning device that can apply pressure as necessary to the pulley axle without coupling to the bowstring;

It is another object of the present invention to provide a bow press that handles the varying torsional forces on bow limbs to provide for increased stability of the system;

It is still another object of the present invention to provide a light weight and compact bow press;

It is yet another object of the present invention to provide an inexpensive bow press that can be manufactured easily;

It is still yet an object of the present invention to provide a portable bow press that is simple to operate and intuitive to use;

It is a further object of the present invention to provide a portable bow press that can be easily applied and disengaged from a compound bow limb section.

SUMMARY OF THE INVENTION

The present invention relates to compound archery bows and, in particular, to an improved attachment device for securing tension on bow limbs in order to provide slack on the bowstring and allow for maintenance. A compound bow generally includes a riser, two limbs (either solid, split or forked), and eccentric pulley(s) attached to one or both of the limbs. The pulleys are attached via an axle perpendicular to the limbs, and rotate as the limbs are flexed. The bowstring is applied to the pulley and runs along the outside of the pulley, along the brace line of the bow, and attaches to the opposite limb (or pulley thereon). The present invention is a portable bow press for tensioning limbs of a compound archery bow that includes three separable pieces that are light, flexible, and easily stored. The first piece is a loop assembly that has a pin, bolt, or other mechanism to attach directly to a pulley. On the first piece, opposite the pulley attachment mechanism, a large loop interacts with the second piece, a steel cable. The third piece of the portable bow press is another loop assembly, substantially the same as the first piece. When the bow press is adapted for a compound bow having two identical cams, one on each limb, the first and second loop assemblies will be virtually identical and interchangeable. The second piece, the connection element, is adapted to have a length that is less than the length of the free bowstring at brace height, or zero draw. The connection element is preferably an elongate, flexible, non-extensible tension bearing cable. The connection element has two loops, one on either end, connected to an S-hook at each end. The loop can be made from a single extended piece of the steel wire, secured with a grasping steel sleeve. The S-hook is permanently and loosely fitted over the end of the connection element, the small end of the S-hook is tapered closed around the steel wire loop.

The S-hooks can be applied within the loop assembly loop elements, and hooked thereto, such that a pressure applied directly opposing the two pieces will prevent the hook attachment from being disconnected. Release can be accomplished by pushing the two pieces together to create slack at the S-hook and loop, allowing for the disengagement of the S-hook from within the loop. As an alternative to the S-hook, any releasably fastening means may be used to connect the connection element to the loop assembly. Releasably fastening means may take the form of a hook, clamp, bolt, loop, pin, clip, anchor, stitch, strap, tie, adhesive (such as velcro), or any other means suitable to attach the connection element to a loop assembly, and that can be manipulated with one hand.

The loop assemblies are connected to the pulley via a pin or bolt that runs through one side of the loop, through a washer element, through a bore or tooling hole within the pulley, through another washer, through the other end of the loop and finally fastened with a nut to maintain all pieces along the bolt.

The invention includes an alternative embodiment wherein the loop assembly or loop assemblies are flipped, such that the retaining means for attachment to the compound archery bow limb, or pulley, takes the form of the loop element. The opposite end of the loop assembly is more permanently affixed to the connection element. The loop element is fitted with either a single loop, or dual loops in parallel such that a single bolt might run through both loops, for interacting with an extended boss or bosses, or nubs, that jut out from the pulley parallel to the rotating axis, but removed slightly from the fulcrum. The bosses can be prefabricated into the pulley at a desired location to facilitate the application of the bow press such that the bosses are accessible at some degree of flexion greater than zero draw.

The invention also includes a method of using this portable bow press. First, the loop assemblies are connected to the respective compound archery bow limbs. If one end has a eccentric pulley, the loop assembly is bolted to the pulley and the other loop assembly is fastened to the opposite limb. If both limbs contain a eccentric pulley, each loop assembly is applied to a respective a pulley on each limb. The loop assemblies are bolted through the pulley by placing the first end of the loop through a bolt, applying a washer, putting the bolt through a bore in the pulley, this tooling hole, or bore, preferably complimentary in size to the bolt, applying a second washer and then the second end of the loop and securing this all with a wing nut. Once both loop assemblies are attached, one connection element end is applied, via a hook, to one of the loops.

A force must be applied to tension the limbs further and bring them closer together. This increase in the potential energy of the limbs can be accomplished by drawing the bowstring. To accomplish this in isolation, as single user can place the bow on the ground facing down, with the pulleys upward, and exert a downwards force by stepping along the riser, as a hand is used to pull the bowstring up. The action will draw the bow and cause the limbs to draw together. While the outside force is applied, a second hand hooks the free end of the connection element on to the loop element of the other loop assembly. Once the connection element is attached to both loop assemblies at both ends, the force is released on the bowstring, while simultaneously transferring tension to connection element.

The bow press may be disengaged by first applying a force draw to the slackened bowstring, increasing the tension on the limbs and causing the limbs to bend inwards. Using the slack transferred now to the bow press, one end of the connection element is unhooked from a loop. Once this connection element has been disengaged, the bowstring is slowly released to allow the limbs to return to a position akin to brace height with all tension born onto the bowstring or other tensioning apparatus.

BRIEF DESCRIPTION OF THE DRAWINGS

The present invention will be described with greater specificity and clarity with reference to the following drawings, in which.

DESCRIPTION OF THE PREFERRED EMBODIMENT

A bow press is designed for small size and light weight to be used by an archer, in the workshop or in the field, and can be applied by one operator. The bow press can preserve the tension on the limbs of the compound bow to allow slack into the bowstring. The tension is set by a particular length of the bow press and is maintained by a steel cord. The cord functions to replace the tension on the pulley in a similar fashion as operated by the bowstring. The pressures at the pulley axle are maintained as though the bowstring is drawn.

Figure 1:
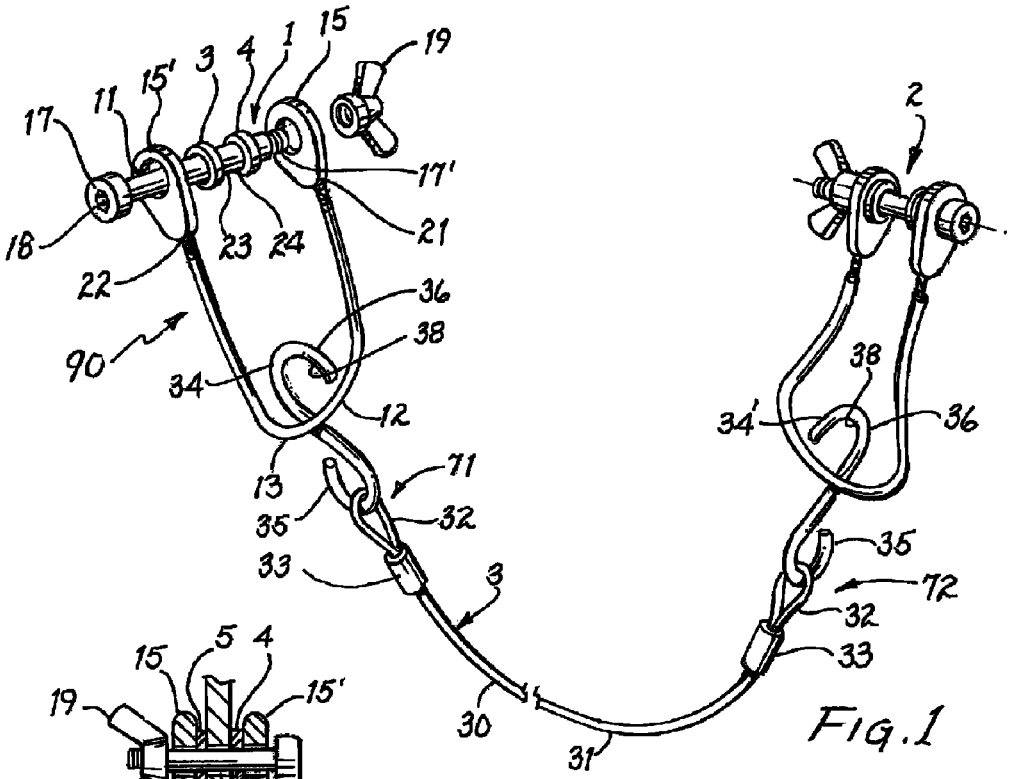
FIG. 1 is a view of a top and bottom loop assembly with a connection cable.

Referring to FIG. 1, there is illustrated a bow press as three separate and interconnectable elements. First and second loop assemblies 1 and 2, respectively, rest at either end of connection cable 3. Loop assemblies 1 and 2 can be either identical or varied, but will be adapted to interconnect with the compound bow, pulley(s) and limbs. Preferably, loop assemblies 1 and 2 are adapted to interconnect with compound bow cams. Once connected, the bow press maintains the tension as though the bow limbs were drawn by a bowstring.

In the preferred embodiment, the loop assemblies contain axle 11 with diameter sufficient to fit through a complementary tooling hole, or bore, in the cam. The holes in the corresponding cams can be situated such that the holes, one in each cam, are at a minimum distance from one another at nearly full draw (nearly full draw defined as more than half draw).

Figure 2:
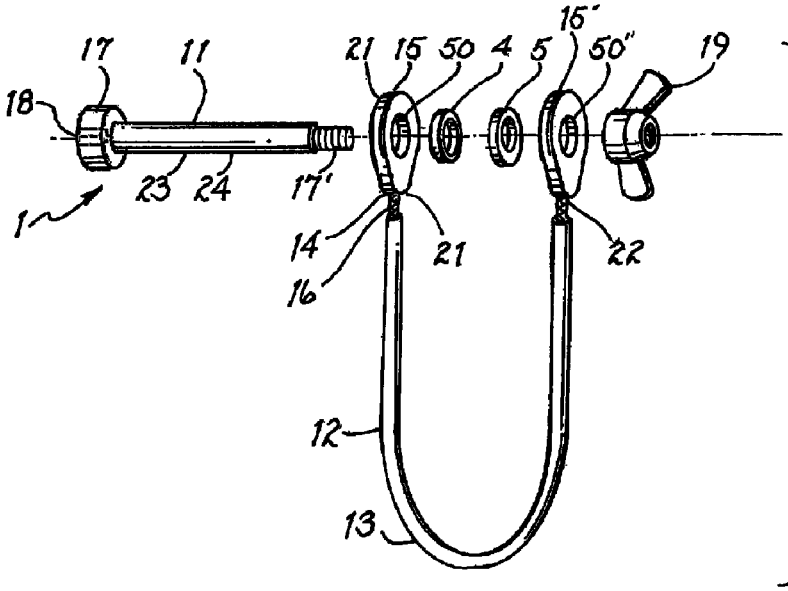
FIG. 2 is an enlarged partial view of one end of a connection cable.

Referring to FIG. 2, loop assembly 1 contains loop element 12 that extends on at least one side of the loop assembly. Loop element 12 is fashioned from high strength tensile metal, preferably steel in a braided fashion or steel wire. The loops can also be made of a stiff hard material permanently fixed in their curvature. Loop element 12 is fitted with a coat 13 of rubberized or polycarbonate material to minimize friction damage when interacting with other elements of the bow press.

Loop wire ends 21 and 22 are exposed portions of the metal wire where the coat 13 does not extend. Loop end 14 of the loop assembly is fitted to axle element 11 by means of mounting anchor elements 15 and 15'. Steel wire 16 is permanently affixed to the mounting anchor element 15 and the anchor interacts directly to the steel wire at loop wire ends 21 and 22. Mounting anchor element 15 has a bore 50 perpendicular to axle 11 when mounted thereon. Bore 50 is slightly greater than the diameter of axle 11 to allow for movement and provide slack once loop assembly 1 is attached to the compound bow. Two washer elements 4 and 5, preferably a hard polycarbonate material, rest between mounting anchors 15 and 15' and slidably engage on axle 11. Enlarged end element 17 is an enlarged piece of axle 11 that has a diameter greater than bore 50. Enlarged end 17 of the bolt contains a hexagonal indentation 18, or other feature, for fitting with an Allen wrench or other like tool. Threaded end 17' of axle 11 contains a threaded surface for engagement with wing nut 19. Wing nut 19 is placed on threaded end 17' and engages threaded end 17' snugly to secure mounting anchors 15 and 15' and washers 4 and 5 upon axle 11.

Referring back to FIG. 1, connection cable 3 is preferably made of a steel cable. Connection cable 3 is of a finite length and is of predominately one-dimensional with two cable ends 71 and 72. Wire cable 30 is fitted with a coat 31 of material similar to that over loop assemblies 1 and 2. In an alternative embodiment, the connection cable is replaced with a stiff bar.

Figure 4A:
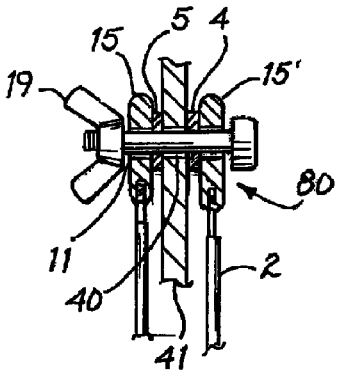
FIG. 4A is a cross-sectional view of a portion of FIG. 4 showing the attachment of a loop assembly to a cam.
Figure 4:
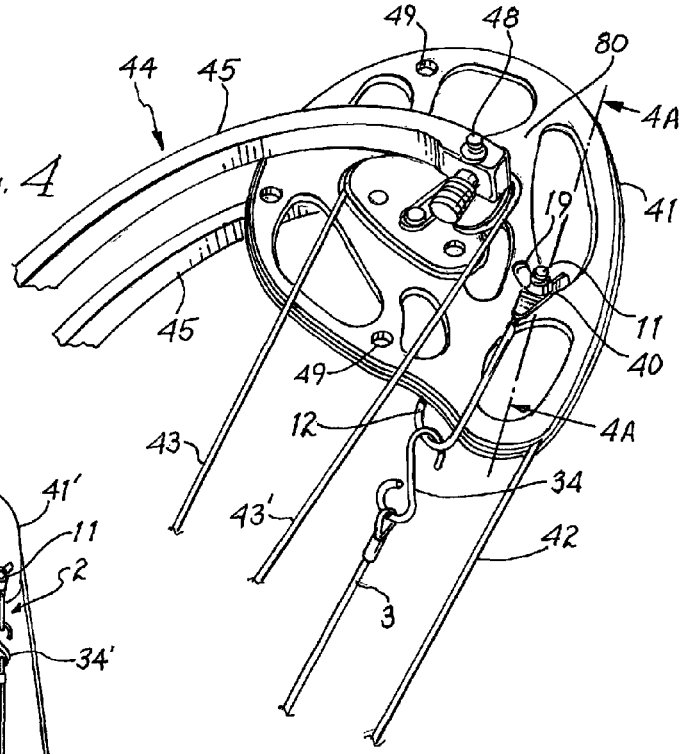
FIG. 4 is a partial view of the invention, illustrating a loop assembly, secured to a compound bow cam and connected to a connection cable.
Figure 5:
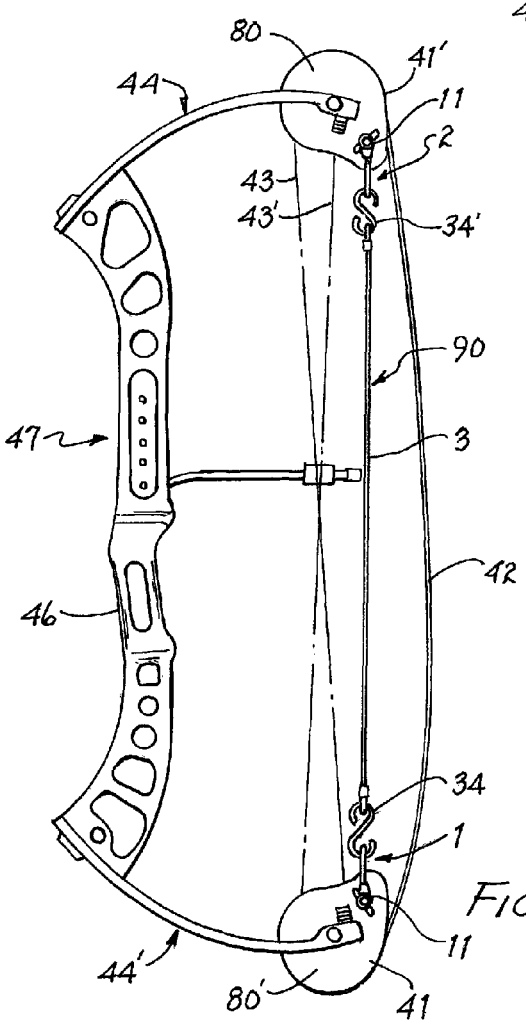
FIG. 5 illustrates an effective application of the invention at full tension, employed with a compound bow.

Referring to FIGS. 4 and 5, zero draw is defined by the curvature of the limbs when enough force is applied to hold the ends of the bow limbs 80 and 80' at a point where the bowstring is at full tension rest, sometimes referred to as brace height. Positive draw occurs as the archer pulls back on the bowstring causing further tension and potential energy to be stored in the increasingly curved limbs. Negative draw is the situation when the bowstring is removed or elongated allowing less curvature of the bow limbs and less overall stored potential energy in the limbs than that at brace height.

Figure 3:
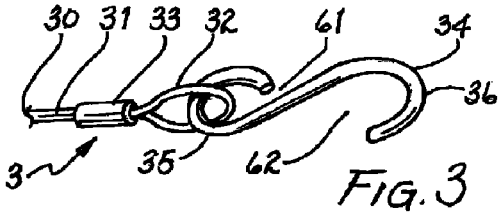
FIG. 3 is an enlarged view of a loop assembly.

Referring to FIG. 3, connection cable 3 is preferably formed of steel, doubled back onto itself, to create cable loop 32. Cable loop 32 is secured via strong clamp or sleeve 33, preferably also of steel. Although wire cable 30 is meant to be a steel wire that is strong, durable, having high tensile strength, the cable should be flexible enough to bend and coil for both storage and manipulation during application of the bow press. Cable loop 32 is fitted with S-hook 34 that fits loosely through cable loop 32. Small end 35 of S-hook 34 has a tapered opening 61 such that the width of the opening is smaller than the combined diameter of wire cable 30 fitted with cable coat 31, preferably smaller than the diameter of wire cable 30 alone, to loosely retain the hook on cable loop 32. S-hook 34 has sufficient clearance within cable loop 32 to allow for easy manipulation and application of the bow press. Large end 36 of S-hook 34 remains open for temporary attachment, via tapered end 62, through loop element 12 of the loop assembly 1.

Referring back to FIG. 2, loop assembly 1 includes a single piece of coated wire, formed into a loop element 12. Mounting anchor elements 15 and 15' are attached at either loop wire end 21 and 22 of steel wire 16. Axle 11 is applied through first mounting anchor element 15 and the washers 4 and 5 and mounting anchor 15' and are placed onto bolt shaft 23. Although axle 11 is preferably of small length, bolt shaft 23 should contain enough length to allow for the cam thickness applied along bolt center 24 of the bolt shaft and between the washer elements 4 and 5.

Referring to FIGS. 4 and 4A, loop assembly 1 is temporarily affixed to cam bore 40 in cam 41. Wing nut 19 serves to secure the loop assembly on the cam. When the bow press is applied to cam 41 at bow limb end 80, axle 11 fits through cam bore 40 and is secured with wing nut 19. Mounting anchors 15 and 15' serve to secure loop element 12 with cam 41. Washers 4 and 5 serve to distribute the load on axle 11 and provide space along the bolt. Connection cable 3 is connected via S-hook 34 to loop assembly 1. Bow cables 43 and 43' interconnect bow limb 44 with the opposite distal bow limb, one cable end attaches proximate to cam axle 48, between bow limb prongs 45, and the other cable end attaches directly to cam 41.

Referring to FIG. 4 in view of FIGS. 1 and 2, the compound archery bow pulley is fitted with a tooling hole or (cam) bore 40 that is complimentary in shape to bolt shaft 23. Additional tooling holes 49 may be formed within the cam 41 to allow for varied placement of the bow press at various bowstring draws. Should the pulley not be fitted with any such complimentary holes, any opening in the pulley can suffice to allow for the application of the loop assembly(ies). Loop assembly 1 is applied via a bolt, such as axle 11 through cam bore 40 and secured with wing nut 19. Loop element 12 remains within bow limbs 44 and 44' and inside bowstring 42. S-hook 34 is applied to loop element 12, large end 36 of S-hook 34 fits in through loop element 12 and loop element 12 contacts with upper interior edge 38 of the hook 34. When the tension is reapplied from limbs 44 and 44', S-hook 34 is in place and cannot be removed until a force greater than that of the limb tension is applied to press the loop assembly 1 (attached to cam 41) towards connection cable 3.

Referring to FIGS. 4 and 5, to apply bow press 90, bowstring 42 must be drawn to a length at which the cams 41 and 41' rotate enough to expose cam bore 40, preferably this can be done at zero draw (at rest). While the bow is in equilibrium, loop assemblies 1 and 2 are attached, one to each cam 41 and 41', through tooling holes 40. Loop assembly 1 and 2 must be taken apart and refitted to allow for axle 11 to engage cam 41 through cam bore 40. If the compound bow contains two pulleys, one on each riser, the order of the placement of the loop assemblies onto the cams does not matter. If necessary, it is preferable to secure the first loop assembly to the top pulley and then affix the second loop assembly to the bottom pulley. Although, the loop assemblies and the connection cable may be placed either top-bottom or bottom top, it is also preferable to connect the top cam-loop assembly to the connection cable before connecting the connection cable to the bottom loop assembly. If the compound bow contains only one pulley set on a limb (the other end of the bowstring fixed directly to the distal limb), it is preferable to connect the loop assembly to the non-pulleyed limb first, and once the second loop assembly is affixed to the pulley, to apply the connection cable to the non-pulleyed limb loop element first, before proceeding to connect the opposite end of the connection cable to the pulley-loop assembly.

To disengage the bow press, the steps described above should be followed in reverse order. The bowstring is drawn, one end of the connection cable is removed from a loop assembly, the bowstring is released slowly until it reestablishes the equilibrium tension on the limbs, the second end of the connection cable is disengaged, and then the loop assemblies can be removed.

Figure 4B:
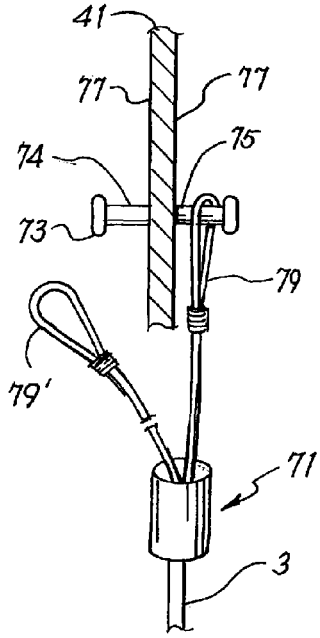
FIG. 4B is a cross-sectional view of a portion of FIG. 4 showing the attachment of a loop assembly to a cam in the alternative embodiment.

Referring to FIG. 4B, in an alternative embodiment, the connection cable 3 is fitted permanently with at least one of the retaining means, such that a separate loop assembly piece is unnecessary. In this embodiment, the bow press may comprise less than three separate sections, and the connection cable include a more permanently affixed retaining means for retaining the pulley(s), or cam(s), of the compound archery bow. The end of the connection cable 71 extends further than the first embodiment to allow application of the bow press at the same amount of draw compared to the first embodiment. The connection cable is fitted, at least at one end 71, with a loop 79, or pair of loops 79 and 79'. When the connection cable end 71 diverges into dual loops, the loops are set in parallel. The loops are preferably single line cord that is doubled over upon itself to form a strong loop to maintain tension without breaking. Once applied, the loops maintain their relative position to the cam and are secured on the bosses by means of an extending force created by the flex of the limbs. The limbs apply an outward force on the connection cable, and the connection cable counters with an identical inward force.

To engage this alternative embodiment, the cam 41 is provided with a pair of bosses 74 and 75 extending from opposite faces 77 and 77' of the cam. This double-bossing would allow for, in the case of a single loop on the end of the connection cord, elective connection, by setting the loop over a boss on the side that is preferable to the user, and in the case of a double-looped connection cable end, the option to place a loop on both sides of the cam. This double-looped option is preferred as it maintains the proper torque at the cam, causing an identical force on either side of the cam axis.

The boss(es) 74 and 75 may be fitted with lip 73. Lip 73 is formed around the circumference of bosses 74 and 75. The lip ensures secure placement of the loop and bow press.

The alternative embodiment, having a connection cable with a built in loop, also referred to as loop assembly, for connecting directly to the cam of the compound archery bow via an abutting boss, the bow press may take many form iterations. The loop assembly end of the connection cable may be fitted in either single or dual loops. The connection cable may have both ends fitted with loops for direct application of the loops to the cam. The connection cable may have a single end fitted with loop(s) to apply to complimentary boss(es) on or in the cam, and the opposite end of the connection cord may take the form of the first embodiment, for interaction with a separate loop assembly piece. Also, should only one end of the connection cable be fitted with loops for direct retention of the cam, the opposite end of the cable may be designed to interact directly with the cam, the limbs, or any other part of the compound archery bow, as is known in the art for attachments, accessories, or the like, with compound archery bows.

FIG. 5 demonstrates bow press 90 applied to compound archery bow 47. Bowstring 42 is slackened to allow for manipulation and replacement. All limb tension is applied through bow press 90 allowing other elements of bow 47, including bowstring 42, bow cables 43 and 43', and other moving parts to be modified. Cams 41 and 41' are at a slight draw and all the force of limbs 44 and 44' is directed through wire cable 30, S-hooks 34 and 34', loop assembly 1 and 2, axle 11, cams 41 and 41' and onto limbs 44 and 44' via cam axle 48. The forces on the pulleys and the limbs is exerted through the bow press and acts directly on the pulley. This force allows for a more stable equilibrium as torque is minimized by the location of the inward forces on the limbs.

We claim:

1. A portable bow press for tensioning limbs of a compound archery bow, the compound bow having limbs, each limb having a limb end, and at least one limb end fitted with a pulley, comprising:

a first loop assembly having first retaining means adapted for detachably interconnecting to the compound archery bow and further comprising a first loop element opposite from said first retaining means;

a second loop assembly having second retaining means for interconnecting to the compound archery bow and further comprising a second loop element opposite from said second retaining means;

a connection cable having a length, a first end, and a second end;

a first releasably fastening means;

a second releasably fastening means;

said first releasably fastening means attached to said connection cable first end and adapted to permanently maintain relative position to said first end;

said second releasably fastening means attached to said connection cable second end and adapted to permanently maintain relative position to said second end;

said first releasably fastening means adapted to interact with said first loop element such that outward force exerted on said first loop assembly and said first releasably fastening means in opposite directions precludes detachment of first releasably fastening means from said first loop element;

said second releasably fastening means adapted to interact with said second loop element such that outward force exerted on said second loop assembly and said second releasably fastening means in opposite directions along a single dimension precludes detachment of second releasably fastening means from said second loop element.

2. The portable bow press of claim 1 wherein said connection cable is an elongate, flexible, non-extensible tension bearing cable and said length of said connection cable is less than the distance between limb ends at zero draw.

3. The portable bow press of claim 1 wherein the first loop assembly first retaining means and the second loop assembly second retaining means are adapted for detachably interconnecting to a pulley.

4. The portable bow press of claim 3 wherein the first and second retaining means form a bolt adapted for interconnection with a complimentary bore in a pulley.

5. A portable bow press for tensioning limbs of a compound archery bow comprising:

a first loop assembly having first retaining means adapted for detachably interconnecting to a pulley by use of a bolt adapted for interconnection with a complimentary bore in said pulley and further comprising a first loop element;

a second loop assembly having a second loop element;

a connection cable having length, first end and second end, said connection cable being a non-extensible tension bearing element and said length of said connection cable is less than the distance between limb ends at zero draw;

said connection cable first end adapted for interconnection with said first loop element;

said connection cable second end adapted for interconnection with said second loop element.

6. The portable bow press of claim 5 further comprising:

said second loop assembly having second retaining means adapted for detachably interconnecting to a pulley by use of a bolt adapted for interconnection with a complimentary bore in a pulley.

7. The portable bow press of claim 6 wherein the first and second retaining means each include a bolt with a first end enlarged to secure elements on the bolt and a second end threaded for engagement with a screw element;

two washers;

said screw element in the shape of a nut to fit over said bolt second end to affix items on said bolt.

8. A method of tensioning the limbs on a compound archery bow, said method comprising the steps of:

a) attaching a first loop assembly to a first limb pulley;

b) attaching a second loop to a second limb;

c) attaching a connection element second end to one of said loop assemblies;

d) applying a force to cause the limbs of the compound archery bow to be flexed;

e) attaching a connection element first end to the other of said loop assemblies;

f) releasing force on compound archery bow limbs while simultaneously transferring tension to the connection element.

9. The method of claim 8 wherein the second loop assembly attachment of step b) is connected to a pulley of said second limb.

10. The method of claim 8 wherein the attachment of steps a) and h) include applying a bolt through the loop assembly; applying said bolt through a bore in the corresponding pulley; and applying said bolt through the loop assembly.

11. The method of claim 10 wherein the attachment steps of a) and b) further include affixing a nut onto said bolt to maintain the loop assembly and pulley on said bolt.

12. The method of claim 11 wherein the attachment steps of a) and b) further include placing two washers on the bolt to separate components and wherein order of placement of elements on the bolt comprises:

a first bolt end, a loop assembly first end, a washer, said pulley bore, a washer, a loop assembly second end, and said nut.

13. The method of claim 8 wherein step d) comprises a force exerted by drawing a bowstring to cause tension on the compound archery bow limbs.

14. The method of claim 8 further comprising the steps of:

g) exerting a force on the limbs of the compound archery bow causing the limbs to bend inwards and closer than that tension provided by the connection element;

h) releasing the attachment of the connection element second end from the corresponding loop assembly;

i) releasing the force on the limbs to allow them to return to a zero or negative draw position;

j) releasing the attachment of the connection element first end from the corresponding loop assembly;

k) disengaging the first loop assembly and the second loop assembly from corresponding compound archery bow limbs.

15. A portable bow press for tensioning limbs of a compound archery bow, the compound bow having limbs, each limb having a limb end, and at least one limb end fitted with a pulley, comprising:

a first loop assembly having first retaining means adapted for detachably interconnecting to the pulley of a compound archery bow;

a cable having a length, a first end, and a second end, wherein said second end comprises said first loop assembly, and said first end having second retaining means for detachably interconnecting to a compound archery how;

said cable having length such that once the cable is applied to a compound bow, an outward force exerted on said first loop assembly and said second retaining means in opposite directions precludes detachment of first and second retaining means.

16. The portable bow press of claim 15 wherein the first loop assembly first retaining means is adapted to loop over an extended boss of said pulley.

17. The portable bow press of claim 15 wherein said second retaining means is comprised of a second loop assembly, said first end having second retaining means adapted for detachably interconnecting to a second pulley of a compound archery bow.

18. The portable bow press of claim 17 wherein said first loop assembly comprises a first retaining means adapted to loop over an extended boss of said first pulley, and wherein said second loop assembly comprises a second retaining means adapted to loop over an extended boss of said second pulley.

* * * * *